US011767766B1

(12) United States Patent
Matthews et al.

(10) Patent No.: US 11,767,766 B1
(45) Date of Patent: Sep. 26, 2023

(54) TURBOMACHINE AIRFOIL HAVING IMPINGEMENT COOLING PASSAGES

(71) Applicant: General Electric Company, Schenectady, NY (US)

(72) Inventors: John M. Matthews, Greer, SC (US); Christopher Donald Porter, Greer, SC (US); Matthew Troy Hafner, Honea Path, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/877,085

(22) Filed: Jul. 29, 2022

(51) Int. Cl.
*F01D 5/18* (2006.01)
*F01D 9/06* (2006.01)
*F01D 25/12* (2006.01)

(52) U.S. Cl.
CPC ..... *F01D 5/187* (2013.01); *F01D 9/06* (2013.01); *F01D 25/12* (2013.01); *F05D 2220/32* (2013.01); *F05D 2240/12* (2013.01); *F05D 2260/201* (2013.01)

(58) Field of Classification Search
CPC ..... F01D 5/187; F01D 5/188; F01D 9/065; F05D 2260/20
See application file for complete search history.

(56) References Cited

U.S. PATENT DOCUMENTS 2,595,999 A 5/1952 Way et al.
2,625,792 A 1/1953 McCarthy et al.
3,433,015 A 3/1969 Sneeden
3,584,972 A 6/1971 Bratkovich et al.
3,657,882 A 4/1972 Hugoson
3,657,883 A 4/1972 DeCorso
3,750,398 A 8/1973 Adeelizzi et al.
4,016,718 A 4/1977 Lauck
4,112,676 A 9/1978 DeCorso
(Continued)

FOREIGN PATENT DOCUMENTS

EA WO1999/064791 A 12/1999
EP 0805308 A1 11/1997
(Continued)

OTHER PUBLICATIONS

Co-Pending U.S. Appl. No. 17/007,089, filed Aug. 31, 2020.
(Continued)

*Primary Examiner* — Eldon T Brockman
(74) *Attorney, Agent, or Firm* — Dority & Manning, P.A.

(57) ABSTRACT

An airfoil includes a leading edge, a trailing edge, a base, and a tip. The airfoil further includes a pressure side wall and a suction side wall that extend between the leading edge, the trailing edge, the base, and the tip. The airfoil further includes a plurality of passages that are defined within the airfoil and extend from an inlet at one of the base or the tip. Each passage of the plurality of passages is defined at least partially by a primary impingement wall and a solid side wall. The primary impingement wall is spaced apart from one of the pressure side wall or the suction side wall such that a primary impingement gap is defined therebetween. The primary impingement wall defines a plurality of impingement apertures that direct air in discrete jets across the impingement gap to impinge upon an interior surface of the airfoil.

17 Claims, 8 Drawing Sheets

(56) References Cited

U.S. PATENT DOCUMENTS 4,158,949 A 6/1979 Reider
4,195,474 A 4/1980 Bintz et al.
4,252,501 A * 2/1981 Peill ..... F01D 9/065 415/115
4,253,301 A 3/1981 Vogt
4,297,843 A 11/1981 Sato et al.
4,373,327 A 2/1983 Adkins
4,413,470 A 11/1983 Scheihing et al.
4,422,288 A 12/1983 Steber
4,498,288 A 2/1985 Vogt
4,566,268 A 1/1986 Hoffeins et al.
4,614,082 A 9/1986 Sterman et al.
4,719,748 A 1/1988 Davis, Jr. et al.
4,720,970 A 1/1988 Hudson et al.
4,798,515 A * 1/1989 Hsia ..... F01D 5/189 415/115
4,802,823 A 2/1989 Decko et al.
4,819,438 A 4/1989 Schultz
4,843,825 A 7/1989 Clark
4,903,477 A 2/1990 Butt
5,075,966 A 12/1991 Mantkowski
5,181,379 A 1/1993 Wakeman et al.
5,207,556 A 5/1993 Frederick et al.
5,237,813 A 8/1993 Harris et al.
5,239,818 A 8/1993 Stickles et al.
5,274,991 A 1/1994 Fitts
5,297,385 A 3/1994 Dubell et al.
5,323,604 A 6/1994 Ekstedt et al.
5,335,491 A 8/1994 Barbier et al.
5,363,654 A 11/1994 Lee
5,415,000 A 5/1995 Mumford et al.
5,480,281 A 1/1996 Correia
5,497,611 A 3/1996 Benz et al.
5,511,375 A 4/1996 Joshi et al.
5,628,192 A 5/1997 Hayes-Bradley et al.
5,640,851 A 6/1997 Toon et al.
5,749,229 A 5/1998 Abuaf et al.
5,761,898 A 6/1998 Barnes et al.
5,822,853 A 10/1998 Ritter et al.
5,826,430 A 10/1998 Little
5,836,164 A 11/1998 Tsukahara et al.
5,839,283 A 11/1998 Dobbeling
5,906,093 A 5/1999 Coslow et al.
5,924,288 A 7/1999 Fortuna et al.
5,960,632 A 10/1999 Abuaf et al.
6,018,950 A 2/2000 Moeller
6,082,111 A 7/2000 Stokes
6,085,514 A 7/2000 Benim et al.
6,098,397 A 8/2000 Glezer et al.
6,109,019 A 8/2000 Sugishita
6,116,013 A 9/2000 Moller
6,116,018 A 9/2000 Tanimura et al.
6,276,142 B1 8/2001 Putz
6,298,656 B1 10/2001 Donovan et al.
6,298,667 B1 10/2001 Glynn et al.
6,339,923 B1 1/2002 Halila et al.
6,345,494 B1 2/2002 Coslow
6,357,237 B1 3/2002 Candy et al.
6,374,593 B1 4/2002 Ziegner
6,397,581 B1 6/2002 Vidal et al.
6,397,602 B2 6/2002 Vandervort et al.
6,412,268 B1 7/2002 Cromer et al.
6,450,762 B1 9/2002 Munshi
6,456,627 B1 9/2002 Frodigh et al.
6,463,742 B2 10/2002 Mandai et al.
6,523,352 B1 2/2003 Takahashi et al.
6,536,216 B2 3/2003 Halila et al.
6,546,627 B1 4/2003 Sekihara et al.
6,568,187 B1 5/2003 Jorgensen et al.
6,607,355 B2 8/2003 Cunha et al.
6,619,915 B1 9/2003 Jorgensen
6,644,032 B1 11/2003 Jorgensen et al.
6,699,015 B2 3/2004 Villhard
6,886,622 B2 5/2005 Villhard
6,889,495 B2 5/2005 Hayashi et al.
6,921,014 B2 7/2005 Hasz et al.
6,951,211 B2 10/2005 Bryant
7,010,921 B2 3/2006 Intile et al.
7,056,093 B2 6/2006 Self et al.
7,104,069 B2 9/2006 Martling et al.
7,197,877 B2 4/2007 Moraes
7,310,938 B2 12/2007 Marcum et al.
7,325,402 B2 2/2008 Parker et al.
7,334,960 B2 2/2008 Glessner et al.
7,437,876 B2 10/2008 Koshoffer
7,493,767 B2 2/2009 Bunker et al.
RE40,658 E 3/2009 Powis et al.
7,665,309 B2 2/2010 Parker et al.
7,690,203 B2 4/2010 Bland
7,707,833 B1 5/2010 Bland et al.
7,789,125 B2 9/2010 Mayer et al.
7,836,703 B2 11/2010 Lee et al.
7,874,138 B2 1/2011 Rubio et al.
7,886,517 B2 2/2011 Chopra et al.
7,921,654 B1 * 4/2011 Liang ..... F01D 5/186 415/115
7,926,278 B2 4/2011 Gerendas et al.
8,011,188 B2 9/2011 Woltmann et al.
8,015,818 B2 9/2011 Wilson et al.
8,104,292 B2 1/2012 Lee et al.
8,123,489 B2 2/2012 Udall et al.
8,141,334 B2 3/2012 Johnson et al.
8,151,570 B2 4/2012 Jennings et al.
8,272,218 B2 9/2012 Fox et al.
8,281,594 B2 10/2012 Wiebe
8,281,595 B2 10/2012 Davis, Jr. et al.
8,307,657 B2 11/2012 Chila
8,375,726 B2 2/2013 Wiebe et al.
8,381,532 B2 2/2013 Berry et al.
8,387,391 B2 3/2013 Patel et al.
8,387,398 B2 3/2013 Martin et al.
8,393,867 B2 3/2013 Chon et al.
8,464,537 B2 6/2013 Khan et al.
8,499,566 B2 8/2013 Lacy et al.
8,511,086 B1 8/2013 Uhm et al.
8,549,857 B2 10/2013 Papile
8,549,861 B2 10/2013 Huffman
8,572,980 B2 11/2013 Winkler et al.
8,590,313 B2 11/2013 Graves et al.
8,616,002 B2 12/2013 Kraemer et al.
8,647,053 B2 2/2014 Hsu et al.
8,667,682 B2 3/2014 Lee et al.
8,720,205 B2 5/2014 Lugg
8,752,386 B2 6/2014 Fox et al.
8,801,428 B2 8/2014 Melton et al.
8,851,402 B2 10/2014 Dinu et al.
9,015,944 B2 4/2015 Lacy et al.
9,016,066 B2 4/2015 Wiebe et al.
9,097,184 B2 8/2015 Stryapunin et al.
9,121,286 B2 9/2015 Dolansky et al.
9,188,335 B2 11/2015 Uhm et al.
9,255,490 B2 2/2016 Mizukami et al.
9,334,808 B2 5/2016 Abe et al.
9,335,050 B2 5/2016 Cunha et al.
9,360,217 B2 6/2016 DiCintio et al.
9,366,437 B2 6/2016 Melton et al.
9,370,846 B2 6/2016 Morimoto et al.
9,395,085 B2 7/2016 Budmir et al.
9,435,539 B2 9/2016 Keener et al.
9,458,767 B2 10/2016 Farrell
9,476,592 B2 10/2016 Berry
9,512,781 B2 12/2016 Mizukami et al.
9,518,478 B2 12/2016 Smith et al.
9,599,343 B2 3/2017 Abd El-Nabi et al.
9,650,958 B2 5/2017 DiCintio et al.
9,759,425 B2 9/2017 Westmoreland et al.
9,777,581 B2 10/2017 Nilsson
9,850,763 B2 12/2017 Itzel et al.
10,024,171 B2 7/2018 Itzel
10,087,844 B2 10/2018 Hughes et al.
10,161,635 B2 12/2018 Pinnick et al.
10,247,103 B2 4/2019 Word et al.
10,267,521 B2 4/2019 Papple et al.
10,520,193 B2 12/2019 Berry

(56) References Cited

U.S. PATENT DOCUMENTS 10,520,194 B2 12/2019 Berry et al.
10,563,869 B2 2/2020 Berry et al.
2002/0043067 A1 4/2002 Maeda et al.
2002/0112483 A1 8/2002 Kondo et al.
2003/0140633 A1 7/2003 Shimizu et al.
2003/0156942 A1 8/2003 Villhard
2003/0167776 A1 9/2003 Coppola
2003/0192320 A1 10/2003 Farmer et al.
2003/0194320 A1 10/2003 Villhard
2004/0060295 A1 4/2004 Mandai et al.
2004/0123849 A1 7/2004 Bryant
2004/0154152 A1 8/2004 Howard et al.
2004/0177837 A1 9/2004 Bryant
2005/0000222 A1 1/2005 Inoue et al.
2005/0056313 A1 3/2005 Hagen et al.
2005/0077341 A1 4/2005 Larrieu et al.
2005/0223713 A1 10/2005 Ziminsky et al.
2006/0038326 A1 2/2006 Vecchiet et al.
2006/0053798 A1 3/2006 Hadder
2006/0070237 A1 4/2006 Johnson et al.
2006/0248898 A1 11/2006 Buelow et al.
2007/0089419 A1 4/2007 Matsumoto et al.
2007/0119565 A1 5/2007 Brunschwiler et al.
2007/0126292 A1 6/2007 Lugg
2008/0006033 A1 1/2008 Scarinci et al.
2008/0208513 A1 8/2008 Dupuy et al.
2008/0276619 A1 11/2008 Chopra et al.
2009/0113893 A1 5/2009 Li et al.
2009/0223227 A1 9/2009 Lipinski et al.
2009/0277177 A1 11/2009 Hessler
2010/0058763 A1 3/2010 Rubio et al.
2010/0058766 A1 3/2010 McMahan et al.
2010/0077719 A1 4/2010 Wilson et al.
2010/0077752 A1 4/2010 Pipile
2010/0139280 A1 6/2010 Lacy et al.
2010/0166564 A1* 7/2010 Benjamin ..... F01D 5/189 416/223 R
2010/0170260 A1 7/2010 Mawatari et al.
2010/0186413 A1 7/2010 Lacy et al.
2010/0205970 A1 8/2010 Hessler et al.
2010/0223931 A1 9/2010 Chila et al.
2010/0272953 A1 10/2010 Yankowich et al.
2010/0287946 A1 11/2010 Buelow et al.
2010/0300115 A1 12/2010 Morimoto et al.
2011/0048030 A1 3/2011 Berry et al.
2011/0076628 A1 3/2011 Miura et al.
2011/0083439 A1 4/2011 Zuo et al.
2011/0103971 A1* 5/2011 Hada ..... F01D 5/189 416/97 R
2011/0123351 A1* 5/2011 Hada ..... F01D 9/065 416/97 R
2011/0179803 A1 7/2011 Berry et al.
2011/0209482 A1 9/2011 Tocian et al.
2011/0247340 A1 10/2011 Popovic et al.
2011/0252805 A1 10/2011 Berry et al.
2011/0314825 A1 12/2011 Stryapunin et al.
2012/0023949 A1 2/2012 Johnson et al.
2012/0031097 A1 2/2012 McMahan et al.
2012/0034075 A1 2/2012 Hsu et al.
2012/0036858 A1 2/2012 Lacy et al.
2012/0114868 A1 5/2012 Bunker et al.
2012/0121381 A1 5/2012 Charron et al.
2012/0121408 A1 5/2012 Lee et al.
2012/0151928 A1 6/2012 Patel et al.
2012/0151929 A1 6/2012 Patel et al.
2012/0151930 A1 6/2012 Patel et al.
2012/0174590 A1 7/2012 Krull et al.
2012/0180487 A1 7/2012 Uhm et al.
2012/0180495 A1 7/2012 Uhm et al.
2012/0198854 A1 8/2012 Schilp et al.
2013/0084534 A1 4/2013 Melton et al.
2013/0086912 A1 4/2013 Berry
2013/0104556 A1 5/2013 Uhm et al.
2013/0122438 A1 5/2013 Stoia et al.
2013/0139511 A1 6/2013 Sometani et al.
2013/0165754 A1 7/2013 McMahan
2013/0167539 A1 7/2013 Berry
2013/0180691 A1 7/2013 Jost et al.
2013/0263571 A1 10/2013 Stoia et al.
2013/0294898 A1 11/2013 Lee
2013/0299602 A1 11/2013 Hughes et al.
2014/0007578 A1 1/2014 Genin et al.
2014/0026579 A1 1/2014 Karlsson et al.
2014/0033718 A1 2/2014 Manoharan et al.
2014/0038070 A1 2/2014 Papile
2014/0060063 A1 3/2014 Boardman et al.
2014/0109580 A1 4/2014 Giri et al.
2014/0144142 A1 5/2014 Abd-El-Nabi et al.
2014/0144152 A1 5/2014 Uhm et al.
2014/0150435 A1 6/2014 Maurer et al.
2014/0150436 A1 6/2014 Eroglu et al.
2014/0157779 A1 6/2014 Uhm et al.
2014/0186098 A1 7/2014 Mironets et al.
2014/0202163 A1 7/2014 Johnson et al.
2014/0237784 A1 8/2014 Lacy et al.
2014/0245738 A1 9/2014 Crothers et al.
2014/0250894 A1 9/2014 Petty, Sr. et al.
2014/0260256 A1 9/2014 Loebig et al.
2014/0260257 A1 9/2014 Rullaud et al.
2014/0260277 A1 9/2014 DiCintio et al.
2014/0260278 A1 9/2014 Hughes
2014/0260282 A1 9/2014 Pinnick et al.
2014/0260327 A1 9/2014 Kottilingam et al.
2014/0290255 A1 10/2014 Akagi et al.
2014/0290272 A1 10/2014 Mulcaire
2014/0338340 A1 11/2014 Melton et al.
2014/0373548 A1 12/2014 Hasselqvist et al.
2015/0000286 A1 1/2015 LeBegue et al.
2015/0030461 A1* 1/2015 Mugglestone ..... F01D 9/065 415/115
2015/0040579 A1 2/2015 Melton
2015/0041590 A1 2/2015 Kirtley et al.
2015/0044059 A1 2/2015 Wassynger et al.
2015/0047361 A1 2/2015 Williams et al.
2015/0059348 A1 3/2015 Toronto et al.
2015/0059357 A1 3/2015 Morgan et al.
2015/0076251 A1 3/2015 Berry
2015/0082795 A1 3/2015 Fadde et al.
2015/0082796 A1 3/2015 Andersson et al.
2015/0135716 A1 3/2015 Ginessin et al.
2015/0096305 A1 4/2015 Morgan et al.
2015/0107262 A1 4/2015 Maurer
2015/0111060 A1 4/2015 Kottilingam et al.
2015/0135718 A1 5/2015 Hughes et al.
2015/0165568 A1 6/2015 Means et al.
2015/0167983 A1 6/2015 McConnaughhay et al.
2015/0219336 A1 8/2015 Crothers et al.
2015/0369068 A1 12/2015 Kottilingam
2015/0375321 A1 12/2015 Cui et al.
2016/0033132 A1 2/2016 Venkatesan et al.
2016/0061453 A1 3/2016 Bethke
2016/0146460 A1 5/2016 Stewart et al.
2016/0146469 A1 5/2016 Lum et al.
2016/0178202 A1 6/2016 Antoniono et al.
2016/0215980 A1 7/2016 Chang
2016/0223201 A1 8/2016 Zink
2016/0369068 A1 12/2016 Reilly, Jr. et al.
2017/0038074 A1 2/2017 Myers et al.
2017/0122562 A1 5/2017 Berry
2017/0138595 A1 5/2017 Berry et al.
2017/0176014 A1 6/2017 Hughes et al.
2017/0203365 A1 7/2017 Pays et al.
2017/0219211 A1 8/2017 Kajimum et al.
2017/0232683 A1 8/2017 Alcantara Marte et al.
2017/0248318 A1 8/2017 Kulkarni
2017/0254539 A1 9/2017 Melton et al.
2017/0260997 A1 9/2017 Mola et al.
2017/0261209 A9 9/2017 Ginessin et al.
2017/0276357 A1 9/2017 Berry et al.
2017/0276358 A1 9/2017 Berry et al.
2017/0276359 A1 9/2017 Berry et al.
2017/0276360 A1 9/2017 Berry et al.
2017/0276361 A1 9/2017 Berry et al.
2017/0276362 A1 9/2017 Berry et al.

(56) References Cited

U.S. PATENT DOCUMENTS

| | | | |
|---|---|---|---|
| 2017/0276363 | A1 | 9/2017 | Berry et al. |
| 2017/0276364 | A1 | 9/2017 | Berry et al. |
| 2017/0276365 | A1 | 9/2017 | Berry et al. |
| 2017/0276366 | A1 | 9/2017 | Berry et al. |
| 2017/0276369 | A1 | 9/2017 | Berry et al. |
| 2017/0279357 | A1 | 9/2017 | Berry et al. |
| 2017/0298827 | A1 | 10/2017 | Berry et al. |
| 2017/0299185 | A1 | 10/2017 | Berry et al. |
| 2017/0299186 | A1 | 10/2017 | Berry et al. |
| 2017/0299187 | A1 | 10/2017 | Berry et al. |
| 2017/0363293 | A1 | 12/2017 | Grooms et al. |
| 2018/0149364 | A1 | 5/2018 | Berry |
| 2018/0172276 | A1 | 6/2018 | Bailey et al. |
| 2018/0187603 | A1 | 7/2018 | Berry |
| 2018/0319077 | A1 | 11/2018 | Blanchet et al. |
| 2018/0328187 | A1 | 11/2018 | Oke |
| 2019/0056112 | A1 | 2/2019 | Natarajan et al. |
| 2019/0154345 | A1 | 5/2019 | Martinez et al. |
| 2020/0277860 | A1* | 9/2020 | Gross ..... F01D 5/186 |

FOREIGN PATENT DOCUMENTS

| | | | |
|---|---|---|---|
| EP | 0815995 | A2 | 1/1998 |
| EP | 1146289 | A1 | 10/2001 |
| EP | 2369235 | A2 | 9/2011 |
| EP | 2378201 | A2 | 10/2011 |
| EP | 2551597 | A2 | 1/2013 |
| EP | 2573325 | A1 | 3/2013 |
| EP | 2613002 | A2 | 7/2013 |
| EP | 2666613 | A1 | 11/2013 |
| EP | 2672182 | A2 | 12/2013 |
| EP | 2685172 | A1 | 1/2014 |
| EP | 2716396 | A1 | 4/2014 |
| EP | 2716868 | A2 | 4/2014 |
| EP | 2722509 | A1 | 4/2014 |
| EP | 2762784 | A1 | 8/2014 |
| EP | 2863018 | A1 | 4/2015 |
| EP | 2905538 | A1 | 8/2015 |
| JP | 3774491 | B2 | 5/2006 |
| JP | 2011/058775 | A | 3/2011 |
| WO | WO2004/035187 | A2 | 4/2004 |
| WO | WO2005/024204 | A1 | 3/2006 |
| WO | WO2007/035298 | A2 | 3/2007 |
| WO | WO2008/076947 | A2 | 6/2008 |
| WO | WO2011/130001 | A2 | 10/2011 |
| WO | WO2014/191495 | A1 | 12/2014 |
| WO | WO2015/057288 | A1 | 4/2015 |

OTHER PUBLICATIONS

Nishimura et al., The Approach to The Development of The Next Generation Gas Turbine and History of Tohoku Electric Power Company Combined Cycle Power Plants, GT2011-45464, Proceedings of ASME Turbo Expo 2011, Vancouver, British Columbia, Canada, Jun. 6-10, 2011, pp. 1-6.

* cited by examiner

TURBOMACHINE AIRFOIL HAVING IMPINGEMENT COOLING PASSAGES

FIELD

The present disclosure relates generally to cooling circuits for turbomachine components. Particularly, the present disclosure relates to an airfoil having a plurality of cooling passages.

BACKGROUND

Turbomachines are utilized in a variety of industries and applications for energy transfer purposes. For example, a gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine as exhaust gases via the exhaust section.

Turbomachine efficiency may be related, at least in part, to the temperature of the combustion gases flowing through the turbine section. For example, the higher the temperature of the combustion gases, the greater the overall efficiency of the turbine. The maximum temperature of the combustion gases may be limited, at least in part, by material properties of the various turbine components such as the airfoils used in the turbine stator vanes and the turbine rotor blades. As such, the components in the turbine section may include various cooling circuits through which compressed air from the compressor section circulates to provide cooling to the various turbine components. However, using a large amount of air from the compressor section to cool the various turbine components may negatively impact the turbomachine efficiency.

Accordingly, an improved airfoil having a cooling circuit that provides adequate cooling to the airfoil while minimizing the amount of air supplied to the cooling circuit from the compressor section is desired and would be appreciated in the art.

BRIEF DESCRIPTION

Aspects and advantages of the airfoils and stator vanes in accordance with the present disclosure will be set forth in part in the following description, or may be obvious from the description, or may be learned through practice of the technology.

In accordance with one embodiment, an airfoil is provided. The airfoil includes a leading edge, a trailing edge, a base, and a tip. The airfoil further includes a pressure side wall and a suction side wall that extend between the leading edge, the trailing edge, the base, and the tip. The airfoil further includes a plurality of passages that are defined within the airfoil and that extend from an inlet at one of the base or the tip. Each passage of the plurality of passages is defined at least partially by a primary impingement wall and a solid side wall. The primary impingement wall is spaced apart from one of the pressure side wall or the suction side wall such that a primary impingement gap is defined therebetween. The primary impingement wall defines a plurality of impingement apertures that direct air in discrete jets across the impingement gap to impinge upon an interior surface of the airfoil.

In accordance with another embodiment, a stator vane is provided. The stator vane includes an inner platform, an outer platform, and an airfoil extending between a base coupled to the inner platform and a tip coupled to the outer platform. The airfoil includes a leading edge, a trailing edge, a base, and a tip. The airfoil further includes a pressure side wall and a suction side wall that extend between the leading edge, the trailing edge, the base, and the tip. The airfoil further includes a plurality of passages that are defined within the airfoil and that extend from an inlet at one of the base or the tip. Each passage of the plurality of passages is defined at least partially by a primary impingement wall and a solid side wall. The primary impingement wall is spaced apart from one of the pressure side wall or the suction side wall such that a primary impingement gap is defined therebetween. The primary impingement wall defines a plurality of impingement apertures that direct air in discrete jets across the impingement gap to impinge upon an interior surface of the airfoil.

These and other features, aspects and advantages of the present airfoils and stator vanes will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present airfoils and stator vanes, including the best mode of making and using the present systems and methods, directed to one of ordinary skill in the art, is set forth in the specification, which makes reference to the appended figures, in which.

DETAILED DESCRIPTION

Figure 1:
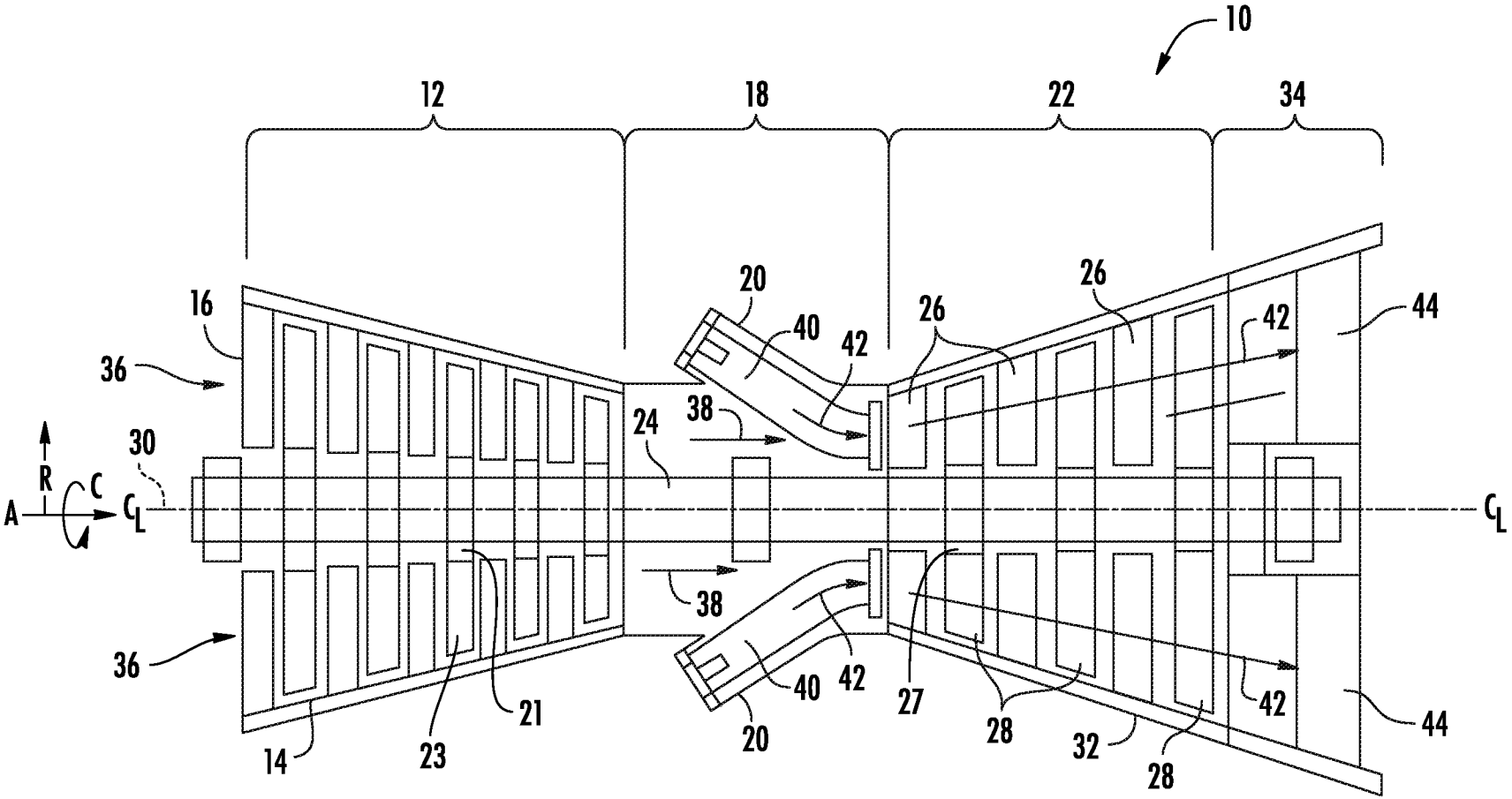
FIG. 1 is a schematic illustration of a turbomachine, in accordance with embodiments of the present disclosure.

Reference now will be made in detail to embodiments of the present airfoils and stator vanes, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

The term "fluid" may be a gas or a liquid. The term "fluid communication" means that a fluid is capable of making the connection between the areas specified.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component, and the term "circumferentially" refers to the relative direction that extends around the axial centerline of a particular component.

Terms of approximation, such as "about," "approximately," "generally," and "substantially," are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. When used in the context of an angle or direction, such terms include within ten degrees greater or less than the stated angle or direction. For example, "generally vertical" includes directions within ten degrees of vertical in any direction, e.g., clockwise or counter-clockwise.

The terms "coupled," "fixed," "attached to," and the like refer to both direct coupling, fixing, or attaching, as well as indirect coupling, fixing, or attaching through one or more intermediate components or features, unless otherwise specified herein. As used herein, the terms"comprises," "comprising," "includes," "including," "has," "having" or any other variation thereof, are intended to cover a non-exclusive inclusion. For example, a process, method, article, or apparatus that comprises a list of features is not necessarily limited only to those features but may include other features that are not expressly listed or that are inherent to such process, method, article, or apparatus. Further, unless expressly stated to the contrary, "or" refers to an inclusive-or and not to an exclusive-or. For example, a condition A or B is satisfied by any one of the following: A is true (or present) and B false (or not present); A is false (or not present) and Bis true (or present); and both A and B are true (or present).

Here and throughout the specification and claims, range limitations are combined and interchanged. Such ranges are identified and include all the sub-ranges contained therein unless context or language indicates otherwise. For example, all ranges disclosed herein are inclusive of the endpoints, and the endpoints are independently combinable with each other.

Referring now to the drawings, FIG. 1 illustrates a schematic diagram of one embodiment of a turbomachine, which in the illustrated embodiment is a gas turbine engine 10. Although an industrial or land-based gas turbine is shown and described herein, the present disclosure is not limited to an industrial or land-based gas turbine unless otherwise specified in the claims. For example, the invention as described herein may be used in any type of turbomachine including but not limited to a steam turbine, an aircraft gas turbine, or a marine gas turbine.

As shown in FIG. 1, the gas turbine engine 10 generally includes a compressor section 12. The compressor section 12 includes a compressor 14. The compressor includes an inlet 16 that is disposed at an upstream end of the gas turbine engine 10. The gas turbine engine 10 further includes a combustion section 18 having one or more combustors 20 disposed downstream from the compressor section 12. The gas turbine engine 10 further includes a turbine section 22 that is downstream from the combustion section 18. A shaft 24 extends generally axially through the gas turbine engine 10.

The compressor section 12 may generally include a plurality of rotor disks 21 and a plurality of rotor blades 23 extending radially outwardly from and connected to each rotor disk 21. Each rotor disk 21 in turn may be coupled to or form a portion of the shaft 24 that extends through the compressor section 12. The rotor blades 23 of the compressor section 12 may include turbomachine airfoils that define an airfoil shape (e.g., having a leading edge, a trailing edge, and side walls extending between the leading edge and the trailing edge).

The turbine section 22 may generally include a plurality of rotor disks 27 and a plurality of rotor blades 28 extending radially outwardly from and being interconnected to each rotor disk 27. Each rotor disk 27 in turn may be coupled to or form a portion of the shaft 24 that extends through the turbine section 22. The turbine section 22 further includes an outer casing 32 that circumferentially surrounds the portion of the shaft 24 and the rotor blades 28. The turbine section 22 may include stator vanes or stationary nozzles 26 extending radially inward from the outer casing 32. The rotor blades 28 and stator vanes 26 may be arranged in alternating stages along an axial centerline 30 of gas turbine 10. Both the rotor blades 28 and the stator vanes 26 may include turbomachine airfoils that define an airfoil shape (e.g., having a leading edge, a trailing edge, and side walls extending between the leading edge and the trailing edge).

In operation, ambient air 36 or other working fluid is drawn into the inlet 16 of the compressor 14 and is progressively compressed to provide a compressed air 38 to the combustion section 18. The compressed air 38 flows into the combustion section 18 and is mixed with fuel to form a combustible mixture. The combustible mixture is burned within a combustion chamber 40 of the combustor 20, thereby generating combustion gases 42 that flow from the combustion chamber 40 into the turbine section 22. Energy (kinetic and/or thermal) is transferred from the combustion gases 42 to the rotor blades 28, causing the shaft 24 to rotate and produce mechanical work. The spent combustion gases 42 ("exhaust gases") exit the turbine section 22 and flow through the exhaust diffuser 34 across a plurality of struts or main airfoils 44 that are disposed within the exhaust diffuser 34.

The gas turbine engine 10 may define a cylindrical coordinate system having an axial direction A extending along the axial centerline 30 coinciding with the shaft 24, a radial direction R perpendicular to the axial centerline 30, and a circumferential direction C extending around the axial centerline 30.

Figure 2:
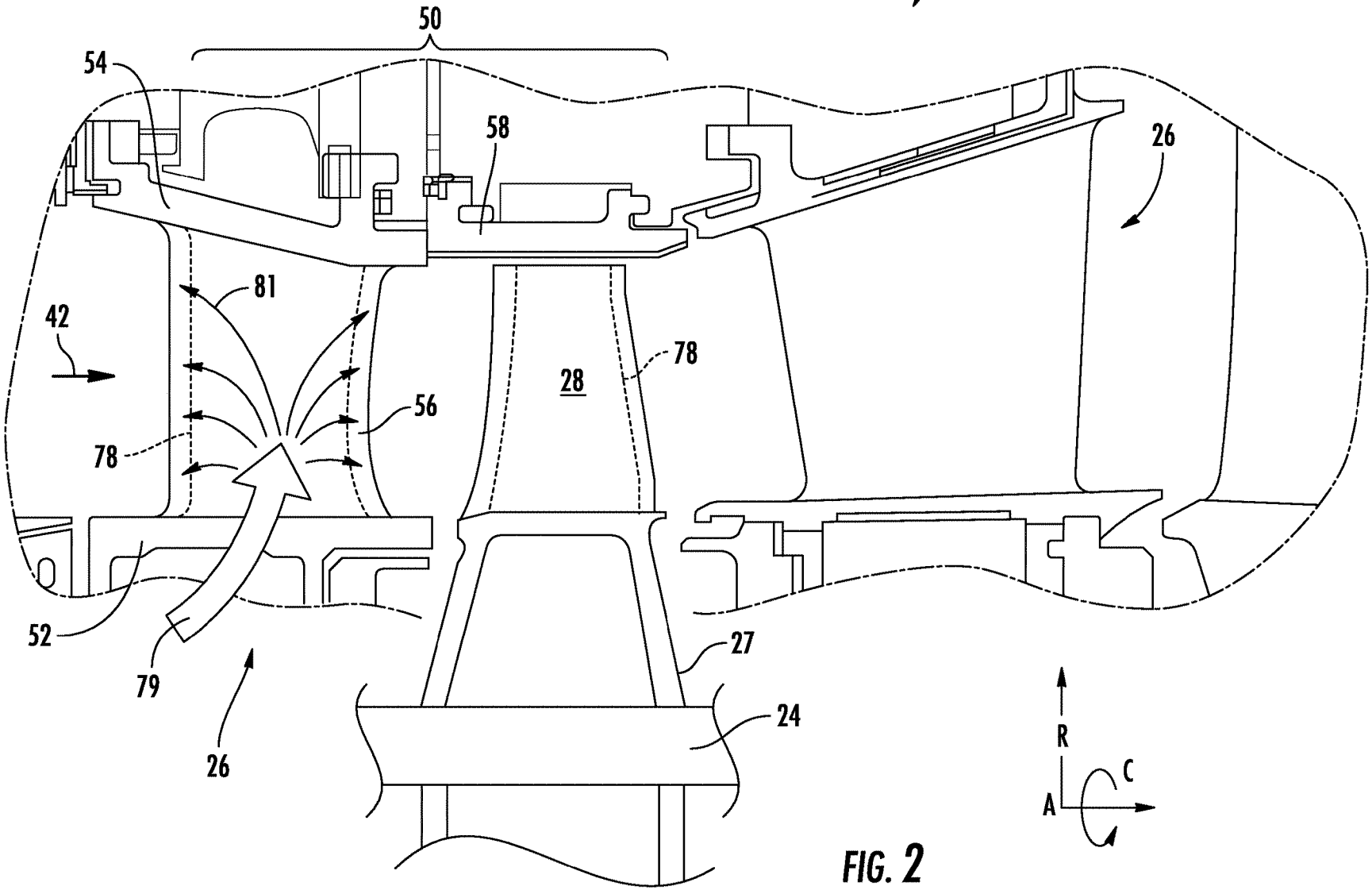
FIG. 2 illustrates a partial cross-sectional side view of a turbine section of the turbomachine of FIG. 1, in accordance with embodiments of the present disclosure.

FIG. 2 is a partial cross-sectional side view of the turbine section 22 of the gas turbine engine 10, in accordance with embodiments of the present disclosure. The turbine section 22 may include one or more stages 50 that each include a set of rotor blades 28 coupled to a rotor disk 27 that may be rotatably attached to the shaft 24. Each stage of the one or more stages 50 may further include a set of stator vanes 26. The stator vane 26 described herein may be employed in a first stage, a second stage, a third stage, or others. As used herein, "first stage" refers to the stage immediately downstream of the combustion section 18, such that the combustion gases engage the first stage stator vane immediately upon exit of the combustion section. In exemplary embodiments, the stator vane 26 described herein may be a first stage stator vane.

Each stator vane 26 may include at least one airfoil 56 that extends in the radial direction R between an inner platform or endwall 52 and an outer platform or endwall 54. The circumferentially adjacent outer platforms 54 of each stator vane 26 may be coupled together to form an outer annular ring extending around an inner annular ring of the circumferentially adjacent inner platforms 52 of each stator vane 26. The at least one airfoil 56 may extend between the two annular rings formed by the platforms 52, 54. The turbine section 22 may also include shroud segments 58, which may be disposed downstream of the outer platform 54 to direct combustion gases 42 flowing past the stator vanes 26 to the rotor blades 28.

Structures or components disposed along the flow path of the combustion gases 42 may be referred to as hot gas path components. In one example, the hot gas path component may be the stator vane 26 and/or the rotor blade 28. In some embodiments, to cool the hot gas path components, cooling features, such as impingement sleeves, cooling channels, cooling holes, etc. may be disposed within the hot gas path components, as indicated by the dashed line 78. For example, cooling air as indicated by an arrow 79 may be routed from the compressor section 12 or elsewhere and directed through the cooling features as indicated by arrows 81. As previously mentioned, to maintain high efficiency of the gas turbine engine 10, it is desirable to minimize the amount of cooling air 79 drawn from the compressor section 12 to cool the hot gas path components 26, 28.

Figure 3:
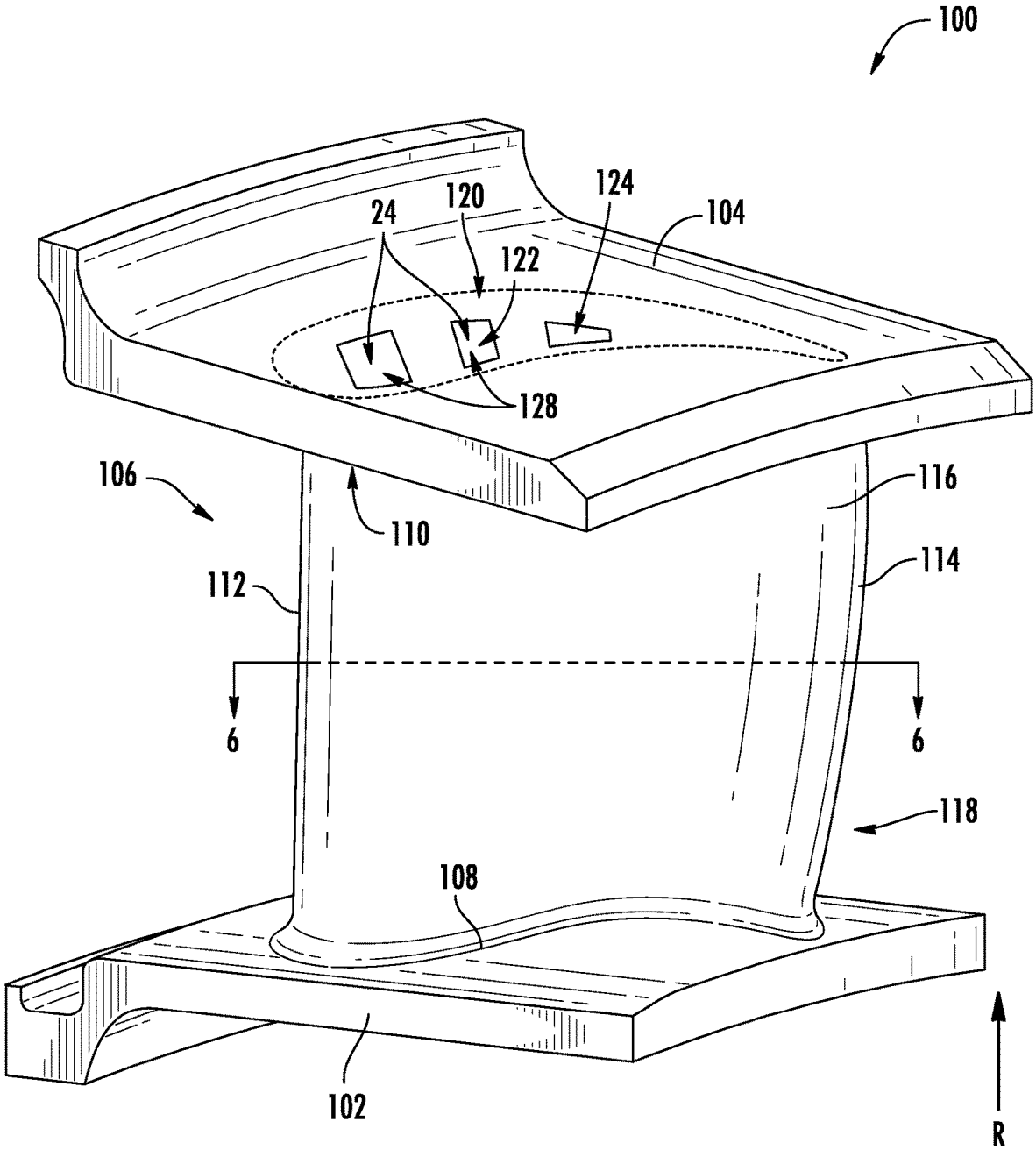
FIG. 3 illustrates a perspective view of a stator vane, in accordance with embodiments of the present disclosure.

Referring now to FIG. 3, a perspective view of a stator vane 100 (26 in FIGS. 1 and 2) is illustrated in accordance with embodiments of the present disclosure. In exemplary embodiments, the stator vane 100 may be a first stage stator vane, such that the stator vane 100 engages the combustion gases immediately after the combustion gases 42 exit the combustion section 18. As shown, the stator vane 100 includes an inner platform 102 spaced apart (e.g., radially spaced apart) from an outer platform 104. The inner platform 102 and the outer platform 104 may define the radially inward/outward flow boundary for the combustion gases 42. An airfoil 106 may extend between the inner platform 102 and the outer platform 104. Particularly, the airfoil 106 may extend radially between a base 108 coupled to the inner platform 102 and a tip 110 coupled to the outer platform 104.

The airfoil 106 may further include a leading edge 112 spaced apart from a trailing edge 114. Additionally, the airfoil 106 may include a pressure side wall 116 and a suction side wall 118 each extending between the leading edge 112 and the trailing edge 114. The airfoil 106 may have a generally aerodynamic contour, such that the combustion gases 42 engage the leading edge 112 and are guided along the pressure side wall 116 and the suction side wall 118 to the trailing edge 114.

In exemplary embodiments, the stator vane 100 may define a cooling circuit 120 extending within the inner platform 102, the outer platform 104, and the airfoil 106 to provide convective cooling to the stator vane 100 during operation of the gas turbine 10. For example, the cooling circuit 120 may be in fluid communication with the compressor section 12, such that the cooling circuit 120 receives a flow of compressed cooling air from the compressor section 12. Particularly, the cooling circuit 120 may include a plurality of passages 122 extending span-wise (or radially) through the airfoil 106 and/or the inner platform 102 and the outer platform 104.

Figure 4:
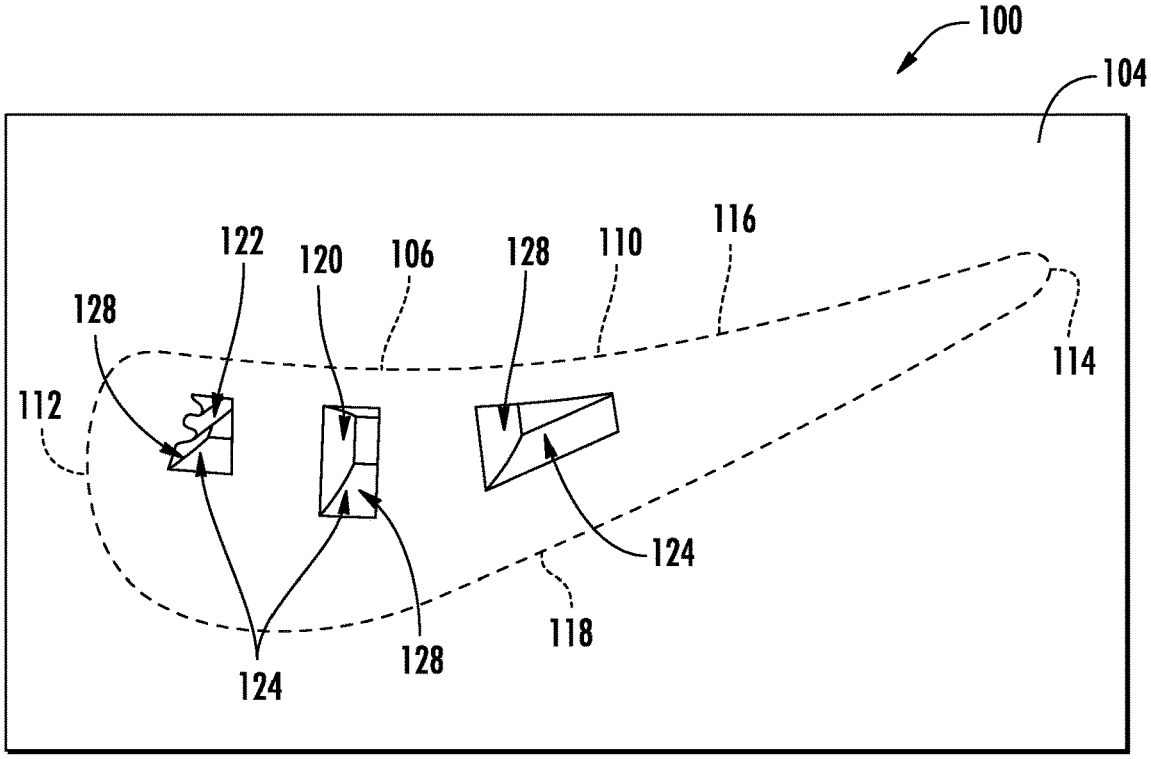
FIG. 4 illustrates a planar view of an outer platform of a stator vane from along the radial direction R, in accordance with embodiments of the present disclosure.
Figure 5:
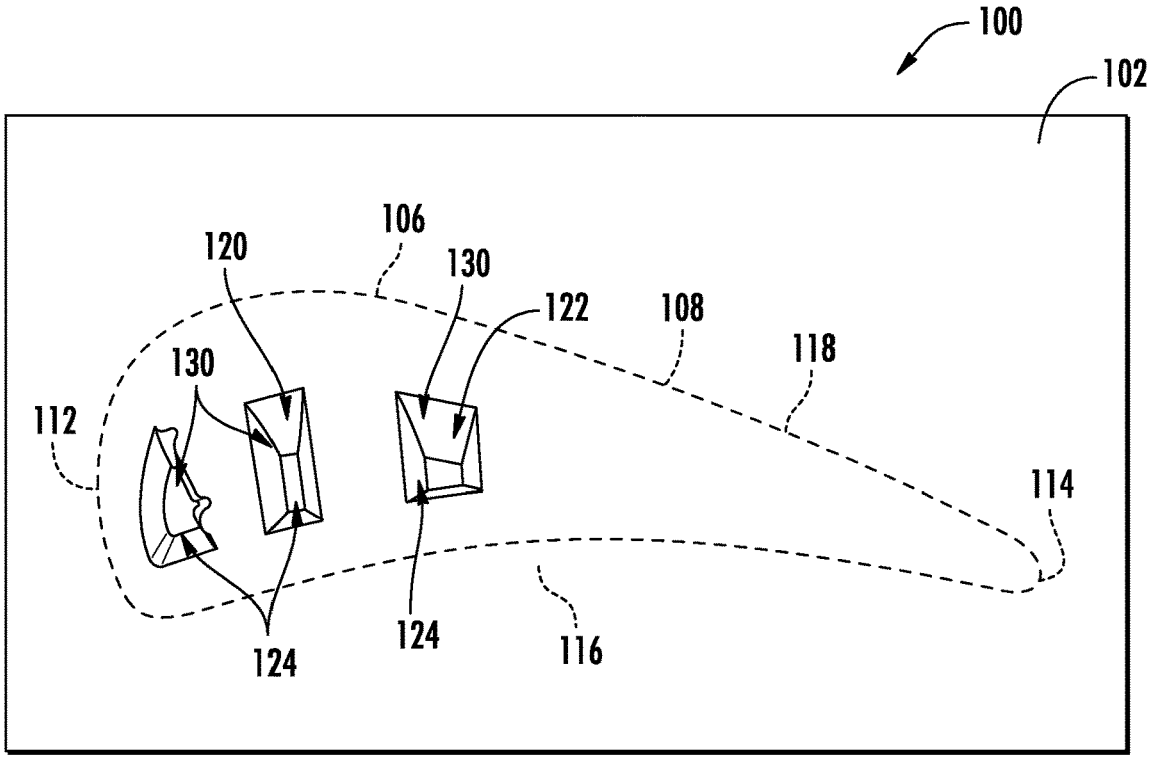
FIG. 5 illustrates a planar view of an inner platform of a stator vane from along the radial direction R, in accordance with embodiments of the present disclosure.
Figure 8:
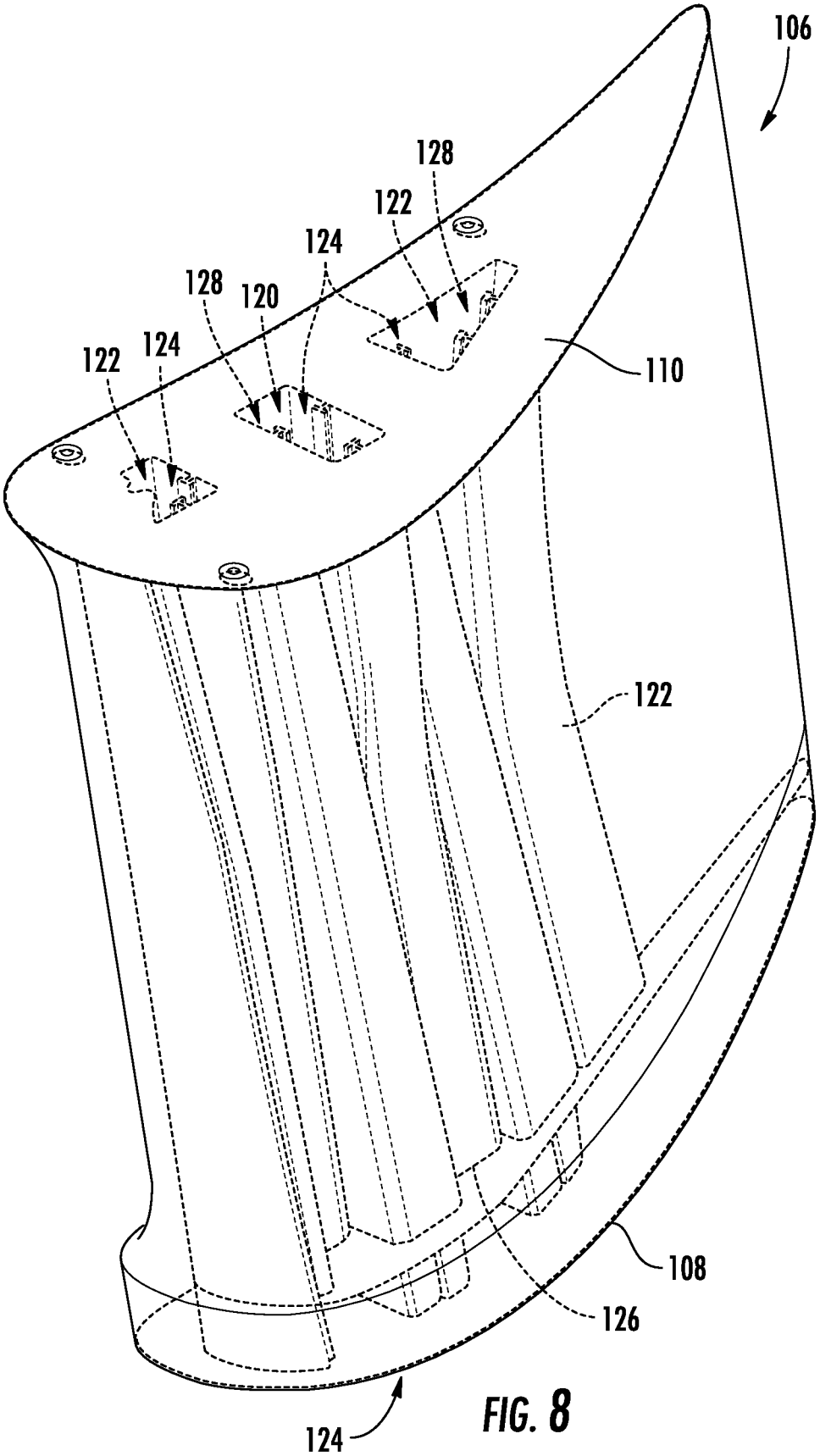
FIG. 8 illustrates a perspective view of an airfoil in which a plurality of passages are shown with dashed lines, in accordance with embodiments of the present disclosure.
Figure 9:
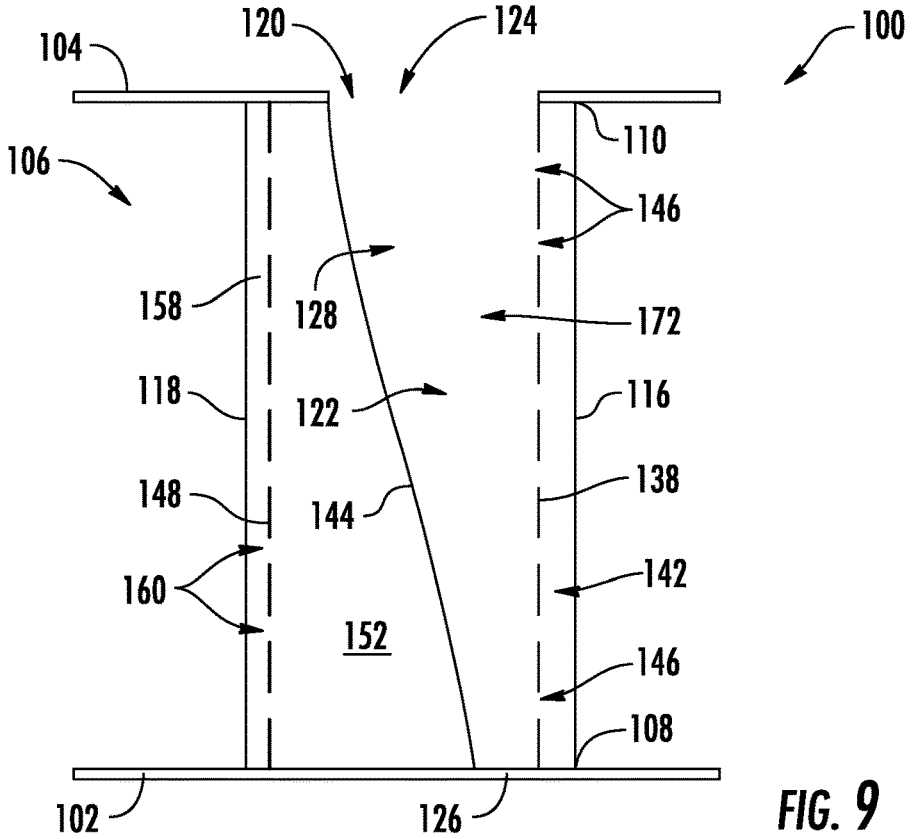
FIG. 9 schematically illustrates a cross-sectional view of the airfoil shown in FIG. 7 from along the line 9-9, in accordance with embodiments of the present disclosure.
Figure 10:
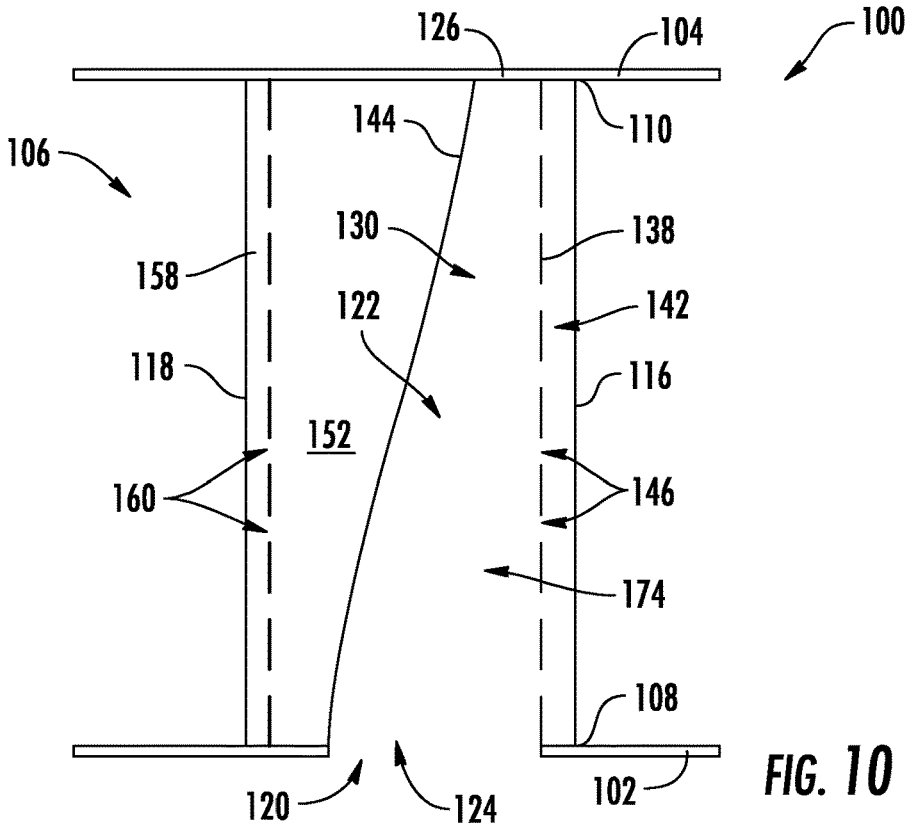
FIG. 10 schematically illustrates a cross-sectional view of the airfoil shown in FIG. 7 from along the line 10-10, in accordance with embodiments of the present disclosure.

Each passage 122 of the plurality of passages 122 may extend (e.g., generally radially) from an inlet 124 defined in one of the base 108 or the tip 110 to a closed end 126 at the other of the base 108 or the tip 110 (as shown in FIGS. 8 through 10). FIG. 4 illustrates a planar view of the outer platform 104 of the stator vane 100 from along the radial direction R, and FIG. 5 illustrates a planar view of the inner platform 102 from along the radial direction R, in accordance with embodiments of the present disclosure. Particularly, FIGS. 4 and 5 illustrate the inlets 124 of the plurality of passages 122.

Figure 7:
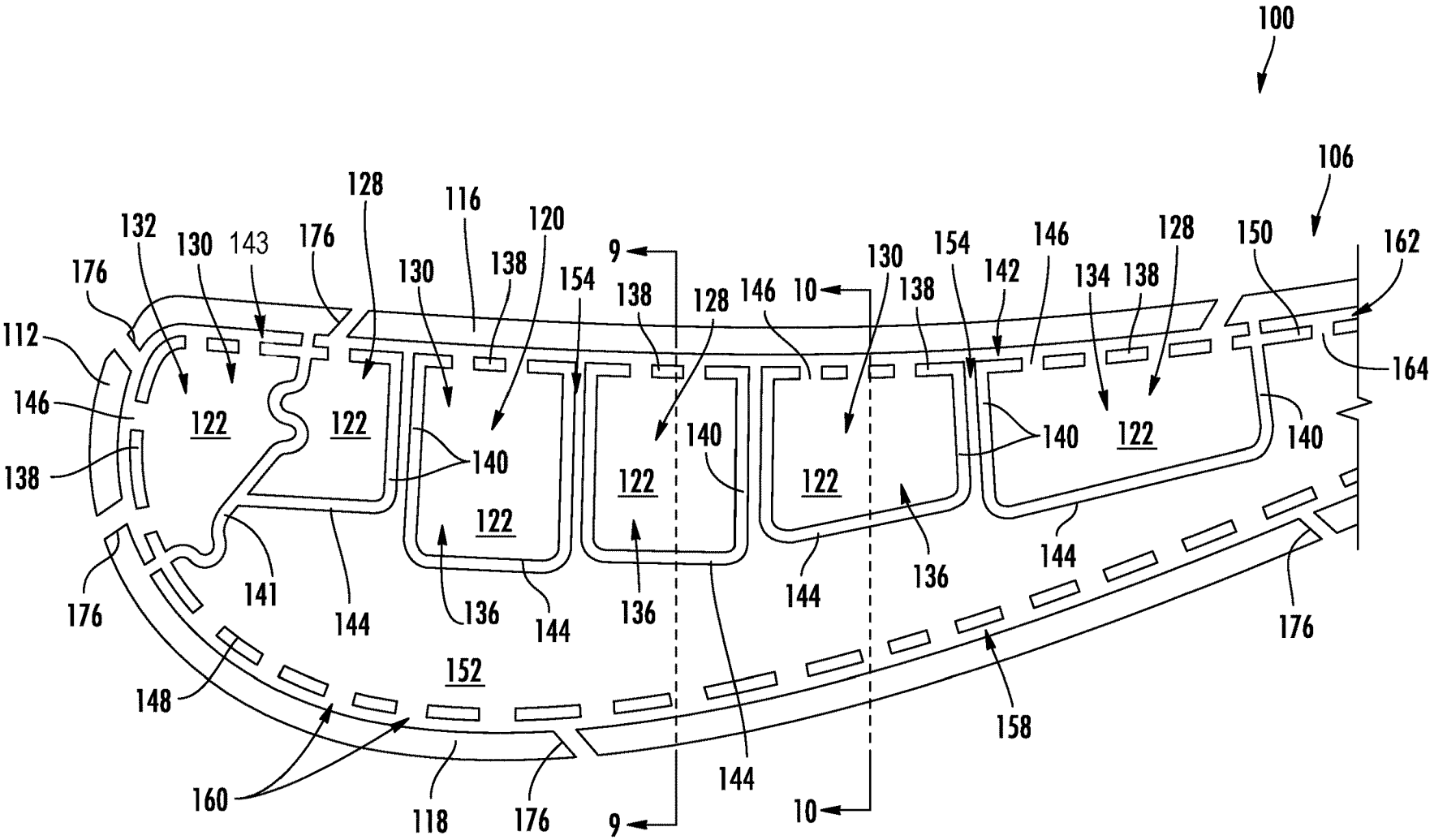
FIG. 7 illustrates an enlarged view of the outline detail shown in FIG. 6, in accordance with embodiments of the present disclosure.

As shown in FIG. 4, the plurality of passages 122 may include outer wall passages 128 having inlets 124 defined through the tip 110 of the airfoil 106 and/or the outer platform 104 of the stator vane 100. Similarly, as shown in FIG. 5, the plurality of passages 122 may include inner wall passages 130 having inlets 124 defined through the base 108 of the airfoil 106 and/or the inner platform 102 of the stator vane 100. Additionally, as shown in FIG. 7, the plurality of passages 122 may include a leading edge passage 132, an aft passage 134, and one or more intermediary passages 136 disposed between the leading edge passage 132 and the aft passage 134. The leading edge passage 132 may be an inner wall passage 130, such that the inlet 124 of the leading edge passage is defined through the base 108 of the airfoil 106 and/or the inner platform 102 of the stator vane 100. By contrast, the aft passage 134 may be an outer wall passage 128, such that the inlet 124 of the aft passage 134 is defined through the tip 110 of the airfoil 106 and/or the outer platform 104 of the stator vane 100.

In exemplary embodiments, as shown by FIGS. 4 and 5 collectively, the inlets 124 of the plurality of passages 122 may be defined in one of the base 108 or the tip 110 of the airfoil 106 (and/or the inner or outer platform 102, 104 of the stator vane 100) in an alternating pattern with respect to a direction extending from the leading edge 112 to the trailing edge 114 of the airfoil 106. In this way, each passage 122 of the plurality of passages 122 may have an inlet defined in one of the base 108 or the tip 110 of the airfoil, and each passage 122 may neighbor another passage 122 having an inlet 124 defined in an opposite end of the airfoil 106 (e.g., the other of the base 108 or of the tip 110 compared to the neighboring passage(s) 122).

Particularly, the airfoil 106 illustrated in FIGS. 4 and 5 may include six passages 122, in which three are outer wall passages 128 and three are inner wall passages 132 in an alternating pattern, as described above. However, it should be appreciated that the airfoil 106 may include any suitable number of passages 122 and should not be limited to any particular number of passages 122 (including outer/inner wall passages 128, 130) or any particular pattern of passages 122, unless specifically recited in the claims.

Figure 6:
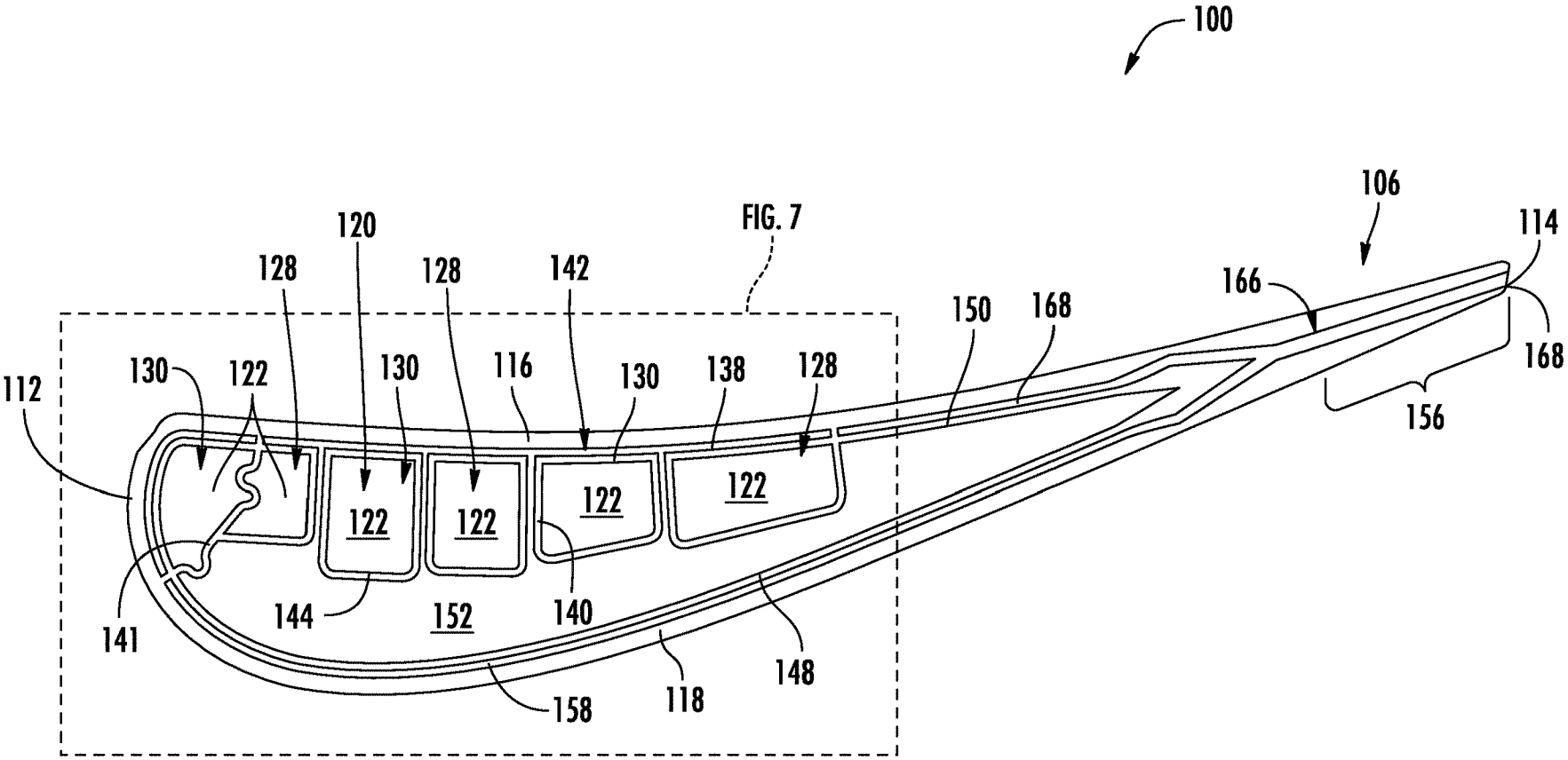
FIG. 6 illustrates a cross-sectional view of the stator vane shown in FIG. 3 from along the line 6-6, in accordance with embodiments of the present disclosure.

FIG. 6 illustrates a cross-sectional view of the stator vane 100 from along the line 6-6 shown in FIG. 3, and FIG. 7 illustrates an enlarged view of the outline detail shown in FIG. 6, in accordance with embodiments of the present disclosure. As shown in FIGS. 6 and 7, each passage 122 of the plurality of passages 122 is defined at least partially by a primary impingement wall 138 and a solid side wall 140.

Particularly, the leading edge passage 132 may have a shared side wall 141 that at least partially defines both the leading edge passage 132 and the neighboring passage 122 of the plurality of passages. The shared side wall 141 may include one or more protrusions (such as a U-shaped protrusion) extending into the passages 122 that the shared side wall 141 partially defines. One or more of the passages 122 of the plurality of passages 122 may be generally rectangular in cross-sectional shape. In various embodiments, one or more of the passages 122 may be collectively defined by two solid side walls 140, a primary impingement wall 138, and a solid end wall 144. The solid end wall 144 may be spaced apart from the primary impingement wall 138, and the two solid side walls 140 may extend between the solid end wall 144 and the primary impingement wall 138. The solid end wall 144 and the primary impingement wall 138 may be generally parallel to one another, and the two solid side walls 140 may be generally parallel to one another. As used herein, "solid" may refer to a wall or other structure that does not include any apertures, passages, holes or other fluid permitting voids, such that the solid structure does not allow for fluid to pass therethrough.

In exemplary embodiments, the primary impingement wall 138 may be spaced apart from one of the pressure side wall 116 or the suction side wall 118 such that a primary impingement gap 142 is defined therebetween. Particularly, the primary impingement wall 138 may be spaced apart from an interior surface of the pressure side wall 116, such that the primary impingement gap 142 is defined therebetween. In certain embodiments, the primary impingement wall 138 may be generally contoured to correspond with the pressure side wall 116, such that the primary impingement gap 142 may define a uniform distance along the entire radial span of the airfoil (e.g., from the base 108 to the tip 110) and along a majority of the pressure side 116 of the airfoil. One end of the shared side wall 141 may extend beyond the primary impingement wall 138 to the interior surface of the pressure side wall 116, and similarly the aft side wall 140 may extend beyond the primary impingement wall 138 to the interior surface of the pressure side wall 116, such that the shared side wall 141 and the aftmost side wall 140 bound the primary impingement gap 142.

In many embodiments, the primary impingement wall 138 may define a plurality of impingement apertures 146 that direct air in discrete jets across the impingement gap to impinge upon an interior surface of the airfoil. For example, the plurality of impingement apertures 146 may be sized and oriented to direct the air in discrete jets to impinge upon the interior surface of the pressure side wall 116. The discrete jets of fluid may have a sufficient velocity and pressure to travel across the primary impingement gap 142 and impinge (or strike) the interior surface of the pressure side wall 116 (as opposed to fluid used for film cooling, which would be at a lower pressure and different orientation). The discrete jets of fluid impinge (or strike) the interior surface and create a thin boundary layer of fluid over the interior surface, which allows for optimal heat transfer between the pressure side wall 116 (or the suction side wall 118) and the fluid.

For example, the plurality of impingement apertures 146 may extend generally perpendicularly through the primary impingement wall 138, such that the plurality of impingement apertures 146 may orient pre-impingement fluid perpendicularly to the surface upon which it strikes, e.g., the interior surface of the pressure side wall 116. Once the fluid has impinged upon the interior surface, it may be referred to as "post-impingement fluid" and/or "spent cooling fluid" because the fluid has undergone an energy transfer and therefore has different characteristics. For example, the spent cooling fluid may have a higher temperature and lower pressure than the pre-impingement fluid because the spent cooling fluid has removed heat from the pressure side wall 116 during the impingement process.

As shown in FIG. 7, along the leading edge 112 of the airfoil 106, one end of the shared side wall 141 may extend beyond the primary impingement wall 138 to the interior surface of the pressure side wall 116 and the other end of the shared side wall 141 may extend beyond the primary impingement wall 138, such that the shared side wall 141 defines opposite boundaries of a leading edge impingement gap 143 between the interior surface of the leading edge 112 and the primary impingement wall 138.

In an exemplary embodiment, as shown in FIGS. 6 and 7, the airfoil 106 may further include a suction side secondary impingement wall 148 and a pressure side secondary impingement wall 150 that partially define a collection chamber or plenum 152. Particularly, the collection chamber 152 may be collectively defined by the shared side wall 141, the solid end walls 144, the suction side secondary impingement wall 148, the pressure side secondary impingement wall 150, and one or more solid side walls 140. The collection chamber 152 may collect the post-impingement fluid that has exited the primary impingement wall 138 and impinged upon the interior surface of the pressure side wall 116.

In particular embodiments, the solid side walls 140 of neighboring passages 122 of the plurality of passages 122 collectively define a collection passage 154 that extends between the primary impingement gap 142 and the collection chamber 152. That is, two neighboring solid side walls 140, which each partially define separate (but neighboring) passages 122, may collectively define the collection passage 154 that extends between and fluidly couples the primary impingement gap 142 to the collection chamber 152. For example, the solid side wall 140 of a first passage of the plurality of passages 122 and the solid side wall 140 of an adjacent second passage of the plurality of passages 122 may collectively define the collection passage 154 extending between the primary impingement gap 142 and the collection passage 152. In this way, air may enter the airfoil 106 via the inlets 124 of the plurality of passages 122 and exit the plurality of passages 122 into the primary impingement gap 142 via the plurality of impingement apertures 146. Subsequently, the post-impingement air may travel through the collection passage 154 into the collection chamber 152. From the collection chamber 152, the air may then travel through the suction side secondary impingement wall 148 and the pressure side secondary impingement wall 150.

In many embodiments, the suction side secondary impingement wall 148 may extend from the solid side wall 140 of a leading edge passage 132 of the plurality of passages toward or to the trailing edge 114. Particularly, the suction side secondary impingement wall 148 may extend from the shared side wall 141 to a trailing edge portion 156. The pressure side wall 116, the suction side wall 118, the suction side secondary impingement wall 148, and the pressure side secondary impingement wall 150 may converge together at the trailing edge portion 156 of the airfoil 106. Additionally, the trailing edge portion 156 may define the trailing edge 114 of the airfoil 106.

In exemplary embodiments, the suction side secondary impingement wall 148 may be spaced apart from the suction side wall 118 such that a secondary impingement gap 158 is defined therebetween. Additionally, a plurality of impingement apertures 160 may be defined in the suction side secondary impingement wall 148 that direct air from the collection chamber 152 in discrete jets across the secondary impingement gap 158 to impinge upon an interior surface of the suction side wall 118. For example, the plurality of impingement apertures 160 may extend generally perpendicularly through the suction side secondary impingement wall 148, such that the plurality of impingement apertures 160 may orient fluid perpendicularly to the surface upon which it strikes, e.g., the interior surface of the suction side wall 118. In many embodiments, the suction side secondary impingement wall 148 may be contoured to correspond with the suction side wall 118, such that the secondary impingement gap 158 may define a uniform distance along the entire radial span of the airfoil (e.g., from the base 108 to the tip 110).

Similarly, in various embodiments, the pressure side secondary impingement wall 150 may extend from the solid side wall 140 of an aft passage 134 of the plurality of passages 122 toward or to the trailing edge 114. Particularly, the pressure side secondary impingement wall 150 may extend from solid side wall 140 of the aft passage 134 to the trailing edge portion 156. In exemplary embodiments, the pressure side secondary impingement wall 150 may be spaced apart from the pressure side wall 116 such that a secondary impingement gap 162 is defined therebetween. Additionally, a plurality of impingement apertures 164 may be defined in the pressure side secondary impingement wall 150 that direct air from the collection chamber 152 in discrete jets across the secondary impingement gap 162 to impinge upon an interior surface of the pressure side wall 116 aft of the passages 122. For example, the plurality of impingement apertures 164 may extend generally perpendicularly through the pressure side secondary impingement wall 150, such that the plurality of impingement apertures 164 may orient fluid perpendicularly to the surface upon which it strikes, e.g., the interior surface of the pressure side wall 116. In many embodiments, the pressure side secondary impingement wall 150 may be contoured to correspond with the aft portion of the pressure side wall 116, such that the secondary impingement gap 162 may define a uniform distance along the entire radial span of the airfoil (e.g., from the base 108 to the tip 110).

In many embodiments, the trailing edge portion 156 may define a trailing edge cooling circuit 166 fluidly coupled to the secondary impingement gap 158 (e.g., the suction side secondary impingement gap) and the secondary impingement gap 162 (e.g., the pressure side secondary impingement gap). As shown, the trailing edge cooling circuit 166 may extend from the secondary impingement gap 158 and the secondary impingement gap 162 to an outlet 168 at the trailing edge 114 of the airfoil 106.

In exemplary embodiments, as shown in FIG. 7, the airfoil 106 may further include one or more film cooling holes 176 defined through the pressure side wall 116 and/or the suction side wall 118. Each of the film cooling holes 176 may be in fluid communication with one of the primary impingement gap 142, the leading edge impingement gap 143, or either of the secondary impingement gaps 160 or 162. The film cooling holes 176 may advantageously provide a thin protective layer of air over the outside surface of the pressure side wall 116, the leading edge 112, and/or the suction side wall 118. The film cooling holes 176 may extend at an angle relative to the surfaces of the wall through which the film cooling hole 176 is defined. For example, a film cooling hole 176 defined through the pressure side wall 116 will extend at an angle (i.e., not perpendicularly) to the interior surface and/or the exterior surface of the pressure side wall 116.

FIG. 8 illustrates a perspective view of the airfoil 106, in which the plurality of passages 122 are shown with dashed lines. As shown, the inlets 124 of the plurality of passages 122 may be defined in one of the base 108 or the tip 110 of the airfoil 106 in an alternating pattern with respect to a direction extending from the leading edge 112 to the trailing edge 114 of the airfoil 106. In this way, each passage 122 of the plurality of passages 122 may have an inlet defined in one of the base 108 or the tip 110 of the airfoil, and each neighboring passage 122 may have an inlet 124 defined in an opposite end of the airfoil 106 (e.g., the other of the base 108 of the tip 110 than the neighboring passage(s) 122).

FIG. 9 schematically illustrates a cross-sectional view of the airfoil 106 from along the line 9-9 shown in FIG. 7, and FIG. 10 schematically illustrates a cross-sectional view of the airfoil 106 from along the line 10-10 shown in FIG. 7, in accordance with embodiments of the present disclosure. Particularly, FIG. 9 may illustrate a first passage 172 of the plurality of passages 122, and FIG. 10 may illustrate a second passage 174 of the plurality of passages. The first passage 172 and the second passage 174 may neighbor one another within the airfoil 106 (FIG. 7). Each passage 122 (including the first and second passages 172, 174) of the plurality of passages 122 may extend (e.g., generally radially) from an inlet 124 defined in one of the base 108 or the tip 110 to a closed end 126 at or proximate to the other of the base 108 or the tip 110. Additionally, the inlets 124 of the plurality of passages 122 may be defined in one of the base 108 or the tip 110 of the airfoil 106 in an alternating pattern with respect to a direction extending from the leading edge 112 to the trailing edge 114 of the airfoil 106. In this way, each passage 122 having an inlet 124 defined at the tip 110 may neighbor one or more passages 122 having an inlet defined at the base 108. For example, as shown in FIGS. 9 and 10, the first passage 172 may extend from an inlet 124 at the tip 110 to a closed end 126 at or proximate to the base 108. By contrast, the second passage 174 (which neighbors the first passage 172) may extend from an inlet 124 at the base 108 to a closed end 126 at or proximate to the tip 110.

Additionally, as shown collectively in FIGS. 7 through 10, each passage 122 of the plurality of passages 122 may converge in cross-sectional area as the passage 122 extends from the inlet 124 to the closed end 126. For example, in some embodiments, each passage 122 may continually converge in cross-sectional area as the passage 122 extends from the inlet 124 to the closed end 126. This advantageously ensures that the air is exiting the plurality of passages 122 via the impingement apertures 146 with sufficient velocity and pressure to traverse the primary impingement gap 142 (at any spanwise or radial location of the airfoil 106). Particularly, the solid end wall 144 may converge towards the primary impingement wall 138 from the inlet 124 of the passage 122 to the closed end 126.

In many embodiments, the airfoil 106 described herein may be integrally formed as a single component. That is, each of the subcomponents, e.g., the primary impingement wall 138, the solid side walls 140, the solid end walls 144, and/or other subcomponents, may be manufactured together as a single body. In exemplary embodiments, this may be done by utilizing an additive manufacturing system and method, such as direct metal laser sintering (DMLS), direct metal laser melting (DMLM), or other suitable additive manufacturing techniques. In this regard, by utilizing additive manufacturing methods, the airfoil 106 may be integrally formed as a single piece of continuous metal and may thus include fewer sub-components and/or joints compared to prior designs. The integral formation of the airfoil 106 through additive manufacturing may advantageously improve the overall assembly process. For example, the integral formation reduces the number of separate parts that must be assembled, thus reducing associated time and overall assembly costs. Additionally, existing issues with, for example, leakage, joint quality between separate parts, and overall performance may advantageously be reduced. Further, the integral formation of the airfoil 106 may favorably reduce the weight of the airfoil 106 as compared to other manufacturing methods.

In other embodiments, other manufacturing techniques, such as casting or other suitable techniques, may be used.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

According to a first aspect, an airfoil comprises: a leading edge, a trailing edge, a base and a tip; a pressure side wall and a suction side wall extending between the leading edge, the trailing edge, the base, and the tip; and a plurality of passages defined within the airfoil and extending from an inlet at one of the base or the tip, wherein each passage of the plurality of passages is defined at least partially by a primary impingement wall and a solid side wall, the primary impingement wall spaced apart from one of the pressure side wall or the suction side wall such that a primary impingement gap is defined therebetween, the primary impingement wall defining a plurality of impingement apertures that direct air in discrete jets across the impingement gap to impinge upon an interior surface of the airfoil.

The airfoil as in any of the preceding clauses, wherein each passage of the plurality of passages extends from the inlet at one of the base or the tip to a closed end at the other of the base or the tip.

The airfoil as in any of the preceding clauses, wherein each passage of the plurality of passages converges in cross-sectional area as the passage extends between the inlet and the closed end.

The airfoil as in any of the preceding clauses, wherein the inlets of the plurality of passages are defined in an alternating pattern in one of the base or the tip of the airfoil with respect to a direction extending from the leading edge to the trailing edge of the airfoil.

The airfoil as in any of the preceding clauses, wherein the airfoil further includes a suction side secondary impingement wall and a pressure side secondary impingement wall that partially define a collection chamber.

The airfoil as in any of the preceding clauses, wherein the solid side wall of a first passage of the plurality of passages and the solid side wall of an adjacent second passage of the plurality of passages collectively define a collection passage extending between the primary impingement gap and the collection chamber.

The airfoil as in any of the preceding clauses, wherein the suction side secondary impingement wall extends from the solid side wall of a leading edge passage of the plurality of passages toward the trailing edge, wherein the suction side secondary impingement wall is spaced apart from the suction side wall such that a secondary impingement gap is defined therebetween, and wherein a plurality of impingement apertures are defined in the suction side secondary impingement wall to direct air from the collection chamber in discrete jets across the secondary impingement gap to impinge upon an interior surface of the suction side wall.

The airfoil as in any of the preceding clauses, wherein the pressure side secondary impingement wall extends from the solid side wall of an aft passage of the plurality of passages toward the trailing edge, wherein the pressure side secondary impingement wall is spaced apart from the pressure side wall such that a secondary impingement gap is defined therebetween, and wherein a plurality of impingement apertures are defined in the pressure side secondary impingement wall to direct air from the collection chamber in discrete jets across the secondary impingement gap to impinge upon an interior surface of the pressure side wall.

The airfoil as in any of the preceding clauses, wherein the primary impingement wall is contoured to correspond with the pressure side wall.

The airfoil as in any of the preceding clauses, wherein the airfoil is integrally formed.

A stator vane comprising: an inner platform; an outer platform; and an airfoil extending between a base coupled to the inner platform and a tip coupled to the outer platform, the airfoil comprising: a leading edge and a trailing edge; a pressure side wall and a suction side wall extending between the leading edge, the trailing edge, the base, and the tip; and a plurality of passages defined within the airfoil and extending from an inlet at one of the base or the tip, wherein each passage of the plurality of passages is defined at least partially by a primary impingement wall and a solid side wall, the primary impingement wall spaced apart from one of the pressure side wall or the suction side wall such that a primary impingement gap is defined therebetween, the primary impingement wall defining a plurality of impingement apertures that direct air in discrete jets across the impingement gap to impinge upon an interior surface of the airfoil.

The stator vane as in any of the preceding clauses, wherein each passage of the plurality of passages extends from the inlet at one of the base or the tip to a closed end at the other of the base or the tip.

The stator vane as in any of the preceding clauses, wherein each passage of the plurality of passages converges in cross-sectional area as the passage extends from the inlet to the closed end.

The stator vane as in any of the preceding clauses, wherein the inlets of the plurality of passages are defined in an alternating pattern in one of the base or the tip of the airfoil with respect to a direction extending from the leading edge to the trailing edge of the airfoil.

The stator vane as in any of the preceding clauses, wherein the airfoil further includes a suction side secondary impingement wall and a pressure side secondary impingement wall that partially define the collection chamber.

The stator vane as in any of the preceding clauses, wherein the side wall of a first passage of the plurality of passages and the solid side wall of a second passage of the plurality of passages collectively define a collection passage extending between the primary impingement gap and the collection passage.

The stator vane as in any of the preceding clauses, wherein the suction side secondary impingement wall extends from the solid side wall of a leading edge passage of the plurality of passages toward the trailing edge, wherein the suction side secondary impingement wall is spaced apart from the suction side wall such that a secondary impingement gap is defined therebetween, and wherein a plurality of impingement apertures are defined in the suction side secondary impingement wall to direct air from the collection chamber in discrete jets across the secondary impingement gap to impinge upon an interior surface of the suction side wall.

The stator vane as in any of the preceding clauses, wherein the pressure side secondary impingement wall extends from the solid side wall of an aft passage of the plurality of passages toward the trailing edge, wherein the pressure side secondary impingement wall is spaced apart from the pressure side wall such that a secondary impingement gap is defined therebetween, and wherein a plurality of impingement apertures are defined in the pressure side secondary impingement wall to direct air from the collection chamber in discrete jets across the secondary impingement gap to impinge upon an interior surface of the pressure side wall.

The stator vane as in any of the preceding clauses, wherein the primary impingement wall is contoured to correspond with the pressure side wall.

The stator vane as in any of the preceding clauses, wherein the airfoil is integrally formed.

What is claimed is:

1. An airfoil comprising:

a leading edge, a trailing edge, a base, and a tip;

a pressure side wall and a suction side wall extending between the leading edge, the trailing edge, the base, and the tip; and a plurality of passages defined within the airfoil and extending from an inlet at one of the base or the tip, wherein each passage of the plurality of passages is defined at least partially by a primary impingement wall and a solid side wall, the primary impingement wall spaced apart from one of the pressure side wall or the suction side wall such that a primary impingement gap is defined therebetween, the primary impingement wall defining a plurality of impingement apertures that direct air in discrete jets across the primary impingement gap to impinge upon an interior surface of the airfoil, wherein each passage of the plurality of passages extends from the inlet at one of the base or the tip to a closed end at the other of the base or the tip, and wherein each passage of the plurality of passages continuously converges in cross-sectional area as the passage extends from the inlet to the closed end.

2. The airfoil as in claim 1, wherein the inlets of the plurality of passages are defined in an alternating pattern in one of the base or the tip of the airfoil with respect to a direction extending from the leading edge to the trailing edge of the airfoil.

3. The airfoil as in claim 1, wherein the airfoil further includes a suction side secondary impingement wall and a pressure side secondary impingement wall that partially define a collection chamber.

4. The airfoil as in claim 3, wherein the solid side wall of a first passage of the plurality of passages and the solid side wall of an adjacent second passage of the plurality of passages collectively define a collection passage extending between the primary impingement gap and the collection chamber.

5. The airfoil as in claim 3, wherein the suction side secondary impingement wall extends from the solid side wall of a leading edge passage of the plurality of passages toward the trailing edge, wherein the suction side secondary impingement wall is spaced apart from the suction side wall such that a secondary impingement gap is defined therebetween, and wherein a plurality of impingement apertures are defined in the suction side secondary impingement wall to direct air from the collection chamber in discrete jets across the secondary impingement gap to impinge upon an interior surface of the suction side wall.

6. The airfoil as in claim 3, wherein the pressure side secondary impingement wall extends from the solid side wall of an aft passage of the plurality of passages toward the trailing edge, wherein the pressure side secondary impingement wall is spaced apart from the pressure side wall such that a secondary impingement gap is defined therebetween, and wherein a plurality of impingement apertures are defined in the pressure side secondary impingement wall to direct air from the collection chamber in discrete jets across the secondary impingement gap to impinge upon an interior surface of the pressure side wall.

7. The airfoil as in claim 1, wherein the primary impingement wall is contoured to correspond with the pressure side wall.

8. The airfoil as in claim 1, wherein the airfoil is integrally formed.

9. A stator vane comprising:

an inner platform;

an outer platform; and an airfoil extending between a base coupled to the inner platform and a tip coupled to the outer platform, the airfoil comprising:

a leading edge and a trailing edge;

a pressure side wall and a suction side wall extending between the leading edge, the trailing edge, the base, and the tip; and a plurality of passages defined within the airfoil and extending from an inlet at one of the base or the tip, wherein each passage of the plurality of passages is defined at least partially by a primary impingement wall and a solid side wall, the primary impingement wall spaced apart from one of the pressure side wall or the suction side wall such that a primary impingement gap is defined therebetween, the primary impingement wall defining a plurality of impingement apertures that direct air in discrete jets across the primary impingement gap to impinge upon an interior surface of the airfoil, wherein each passage of the plurality of passages extends from the inlet at one of the base or the tip to a closed end at the other of the base or the tip, and wherein each passage of the plurality of passages continuously converges in cross-sectional area as the passage extends from the inlet to the closed end.

10. The stator vane as in claim 9, wherein the inlets of the plurality of passages are defined in an alternating pattern in one of the base or the tip of the airfoil with respect to a direction extending from the leading edge to the trailing edge of the airfoil.

11. The stator vane as in claim 9, wherein the airfoil further includes a suction side secondary impingement wall and a pressure side secondary impingement wall that partially define a collection chamber.

12. The stator vane as in claim 11, wherein the side wall of a first passage of the plurality of passages and the solid side wall of a second passage of the plurality of passages collectively define a collection passage extending between the primary impingement gap and the collection chamber.

13. The stator vane as in claim 11, wherein the suction side secondary impingement wall extends from the solid side wall of a leading edge passage of the plurality of passages toward the trailing edge, wherein the suction side secondary impingement wall is spaced apart from the suction side wall such that a secondary impingement gap is defined therebetween, and wherein a plurality of impingement apertures are defined in the suction side secondary impingement wall to direct air from the collection chamber in discrete jets across the secondary impingement gap to impinge upon an interior surface of the suction side wall.

14. The stator vane as in claim 11, wherein the pressure side secondary impingement wall extends from the solid side wall of an aft passage of the plurality of passages toward the trailing edge, wherein the pressure side secondary impingement wall is spaced apart from the pressure side wall such that a secondary impingement gap is defined therebetween, and wherein a plurality of impingement apertures are defined in the pressure side secondary impingement wall to direct air from the collection chamber in discrete jets across the secondary impingement gap to impinge upon an interior surface of the pressure side wall.

15. The stator vane as in claim 9, wherein the primary impingement wall is contoured to correspond with the pressure side wall.

16. The stator vane as in claim 9, wherein the airfoil is integrally formed.

17. An airfoil comprising:

a leading edge, a trailing edge, a base, and a tip;

a pressure side wall and a suction side wall extending between the leading edge, the trailing edge, the base, and the tip;

a plurality of passages defined within the airfoil and extending from an inlet at one of the base or the tip, wherein each passage of the plurality of passages is defined at least partially by a primary impingement wall and a solid side wall, the primary impingement wall spaced apart from one of the pressure side wall or the suction side wall such that a primary impingement gap is defined therebetween, the primary impingement wall defining a plurality of impingement apertures that direct air in discrete jets across the primary impingement gap to impinge upon an interior surface of the airfoil; and a suction side secondary impingement wall and a pressure side secondary impingement wall that partially define a collection chamber, wherein the suction side secondary impingement wall extends from the solid side wall of a leading edge passage of the plurality of passages toward the trailing edge, wherein the suction side secondary impingement wall is spaced apart from the suction side wall such that a secondary impingement gap is defined therebetween, and wherein a plurality of impingement apertures are defined in the suction side secondary impingement wall to direct air from the collection chamber in discrete jets across the secondary impingement gap to impinge upon an interior surface of the suction side wall.

* * * * *